US009214273B2

(12) United States Patent
Ballard et al.

(10) Patent No.: US 9,214,273 B2
(45) Date of Patent: Dec. 15, 2015

(54) RADIAL DROP WINDING FOR OPEN-WOUND MEDIUM VOLTAGE DRY TYPE TRANSFORMERS WITH IMPROVED SUPPORT STRUCTURE

(71) Applicant: ABB Technology AG, Zurich (CH)

(72) Inventors: Robert C. Ballard, Wytheville, VA (US); Josiah Levi Vandervelde, Jackson, MS (US); William Edward Pauley, Jr., Bland, VA (US); Joseph Leo Tedesco, Draper, VA (US)

(73) Assignee: ABB Technology AG, Zürich (CH)

( * ) Notice: Subject to any disclaimer, the term of this patent is extended or adjusted under 35 U.S.C. 154(b) by 0 days.

(21) Appl. No.: 14/101,440

(22) Filed: Dec. 10, 2013

(65) Prior Publication Data

US 2014/0361862 A1 Dec. 11, 2014

Related U.S. Application Data

(63) Continuation-in-part of application No. 13/914,669, filed on Jun. 11, 2013.

(51) Int. Cl.

| | |
|---|---|
| ***H01F 27/30*** | (2006.01) |
| ***H01F 41/06*** | (2006.01) |
| ***H01F 27/32*** | (2006.01) |

(52) U.S. Cl.

CPC ..... *H01F 27/306* (2013.01); *H01F 27/322* (2013.01); *H01F 41/0687* (2013.01); *H01F 27/324* (2013.01)

(58) Field of Classification Search

CPC ..... H01F 27/30; H01F 27/303; H01F 27/306; H01F 27/322; H01F 27/324; H01F 27/28; H01F 27/32; H01F 27/323; H01F 41/0687

USPC ..... 336/222, 199, 197, 196, 206–208; 242/433

See application file for complete search history.

(56) References Cited

U.S. PATENT DOCUMENTS

| | | | | |
|---|---|---|---|---|
| 1,386,838 | A * | 8/1921 | Burnham | 336/182 |
| 1,644,135 | A * | 10/1927 | Kirke | 336/185 |
| 1,938,421 | A * | 12/1933 | Gilbert | 336/185 |
| 2,904,760 | A * | 9/1959 | Johnston | 336/60 |
| 3,327,267 | A | 6/1967 | Seidel et al. | |
| 3,548,355 | A * | 12/1970 | Miller et al. | 336/60 |
| 4,521,856 | A * | 6/1985 | Phelps et al. | 701/90 |
| 2007/0279177 | A1 * | 12/2007 | Sarver et al. | 336/207 |
| 2011/0210812 | A1 * | 9/2011 | Charwat et al. | 336/210 |

FOREIGN PATENT DOCUMENTS

| | | |
|---|---|---|
| CH | 567327 A5 | 9/1975 |
| DE | 102005030014 B3 | 11/2006 |
| WO | WO 2008/131889 | 11/2008 |

OTHER PUBLICATIONS

International Search Report and Written Opinion in PCT/US2014/067852 dated Mar. 13, 2015.

* cited by examiner

*Primary Examiner* — Mangtin Lian

(74) *Attorney, Agent, or Firm* — Manelli Selter PLLC; Edward J. Stemberger

(57) ABSTRACT

A method provides a radial drop winding for an open wound transformer. A plurality of non-electrically conductive posts are arranged to define an interior space. Each post is of generally L-shape having a main body and a leg extending from a bottom end of the main body. During an open winding process, conductive wire is dropped to build up lengthwise along the posts to define at least one generally cylindrical winding segment supported by the legs of the posts.

11 Claims, 6 Drawing Sheets

RADIAL DROP WINDING FOR OPEN-WOUND MEDIUM VOLTAGE DRY TYPE TRANSFORMERS WITH IMPROVED SUPPORT STRUCTURE

This application is a continuation-in-part of U.S. application Ser. No. 13/914,669, filed on Jun. 11, 2013, the content of which is hereby incorporated by reference into this specification.

FIELD

The invention relates to dry type transformers and, more particularly, to a radial drop winding for open wound medium voltage dry type transformers.

BACKGROUND

Dry type transformer windings incorporate a conductor, typically of aluminum or copper, and solid insulation to prevent dielectric failure. There are multiple conventional methods to control the geometry of these transformers to keep labor and material cost as low as possible. One of the metrics to determine material content is the fill factor or the amount of space inside a coil used for the conductor.

Radial drop winding techniques are typically used with coils that are vacuum cast using removable metal molds to hold the windings in place until the epoxy is rigid enough to support the mechanical forces.

Thus, there is a need to provide a radial drop winding for open wound/ventilated coils without relying on the vacuum cast or resin encapsulated process so as to reduce labor cost.

SUMMARY

An object of the invention is to fulfill the need referred to above. In accordance with the principles of the present invention, this objective is obtained by a method that provides a medium voltage radial drop winding for an open wound transformer. The method provides a plurality of non-electrically conductive posts arranged to define an interior space. Each post is of generally L-shape having a main body and a leg extending from a bottom end of the main body. During an open winding process, conductive wire is dropped to build up lengthwise along the posts to define at least one generally cylindrical winding segment supported by the legs of the posts.

In accordance with another aspect of the disclosed embodiment, a radial drop winding for an open wound transformer includes support structure having a plurality of non-electrically conductive posts. Each post is of generally L-shape having a main body and a leg extending from a bottom end of the main body. The posts are arranged so as to define an interior space. At least one generally cylindrical winding segment including conductive wire is disposed about the posts and supported by the legs.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF AN EXEMPLARY EMBODIMENT

Figure 1:
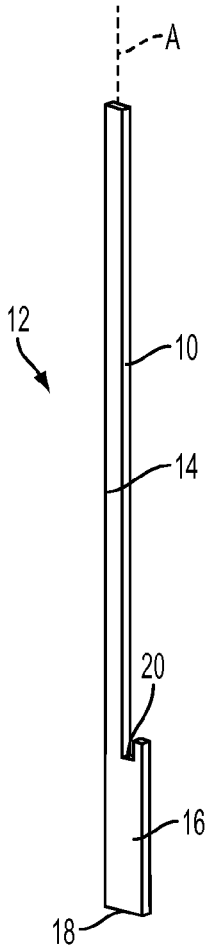
FIG. 1 is a perspective view of a post of support structure for a medium voltage radial drop winding in accordance with an embodiment of the invention.
Figure 3:
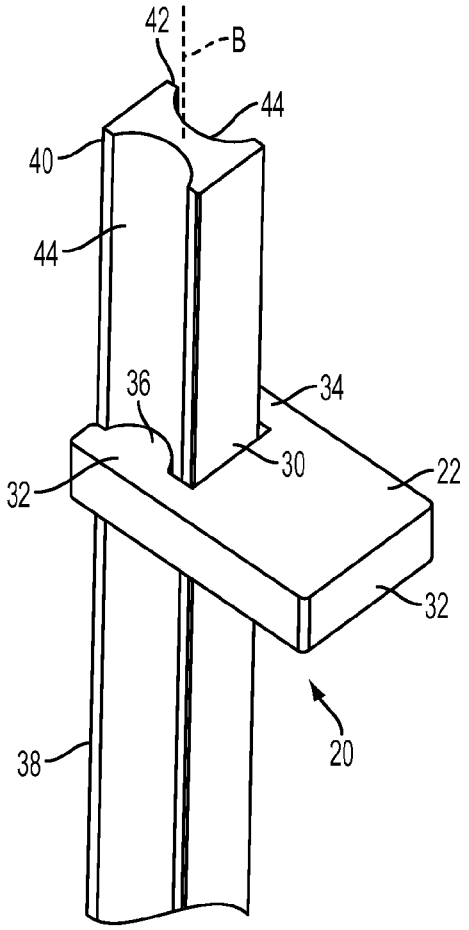
FIG. 3 is a perspective view of the spacer structure defined by the joining of the spacer of FIG. 2 with a spacer guide.

With reference to FIGS. 1 and 3, a post 10 is shown to define a mechanical support structure 12 for windings as will be explained below. The post 10 is elongated and generally L-shaped, having a main body 14 and a leg 16 at a bottom end 18 of the post 10. The leg 16 extends generally transversely with respect to an axis A of the main body 14. A slot 20 is defined in the leg 16, the function of which will be explained below.

Figure 2:
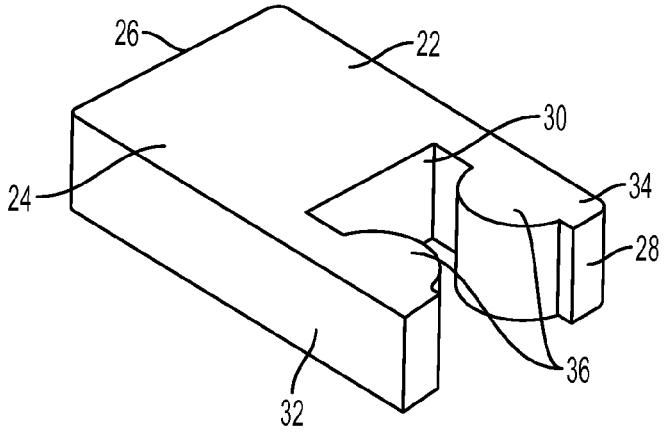
FIG. 2 is a perspective view of a spacer of spacer structure of a medium voltage radial drop winding in accordance with an embodiment of the invention.

With reference to FIG. 3, a spacer structure is shown, generally indicated at 20. As best shown in FIG. 2, the spacer structure 20 includes a spacer 22 having a body 24 with a first end 26 and an opposing second end 28. A keyway or slot 30 is provided in the second end 28 so as to define first and second opposing legs 32 and 34, respectively. Each leg 32, 34 includes a convex protrusion 36. Returning to FIG. 3, the spacer structure 20 also includes a spacer guide 38 having opposing sides 40 and 42, with each side including an elongated channel 44 defined therein. In the embodiment, each channel 44 is defined as a generally arc-shaped trough so as to define a "dog bone" structure. A portion of the spacer guide 38 is received in the generally rectangular slot 30 of the spacer 22 with the protrusions 36 frictionally and slidably engaging the surfaces defining the channels 44 of the guide 38. Thus, the spacer 22 is slidable along axis B of the guide 38.

Figure 4:
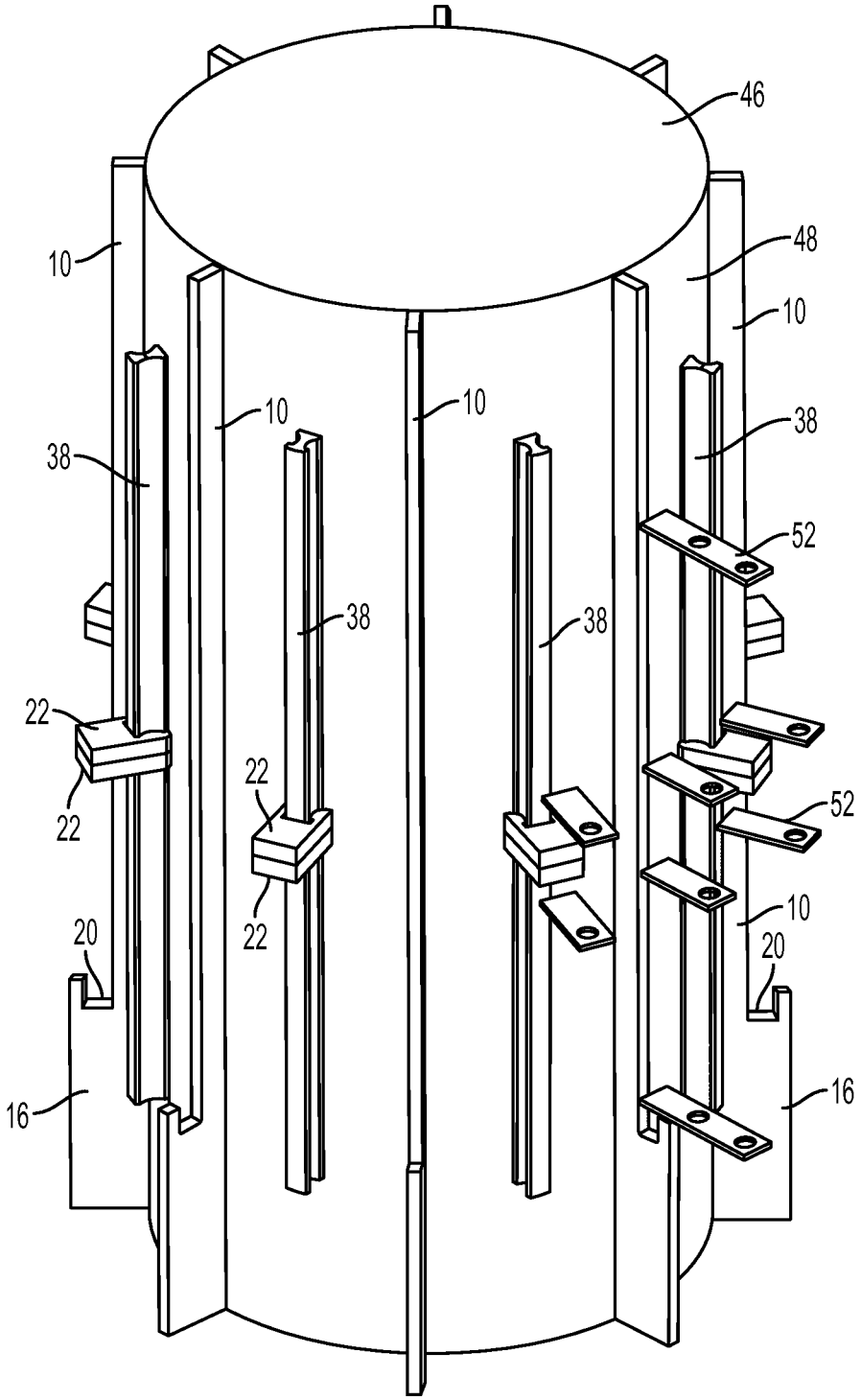
FIG. 4 is view of a barrier of a medium voltage radial drop winding that includes the support structure defined by the post of FIG. 1 and the spacer structure of FIG. 3.

The post 10 and spacer structure 20 are of non-electrically conductive material such as polyester glass. With reference to FIG. 4, each post 10 and guide 38 is arranged to extend from a periphery of an imaginary geometric shape such as a circle to define an interior space 46. Other geometrical shapes can be used instead of circle, such as a rectangle, square, octagon, hexagon, oval, etc. The separate posts 10 and guides 38 can be connected by tape or the like. Preferably, the posts 10 and guides 38 are spaced evenly around the periphery of the circle or, as shown in the embodiment of FIG. 4, they are spaced around a periphery of a conventional cylindrical HiLo barrier 48 having the interior space 46 that is provided for dielectrics and cooling. Voltage adjustment taps 52 are also shown in FIG. 4. In the embodiment, each guide 38 is provided between two posts 10.

Figure 5:
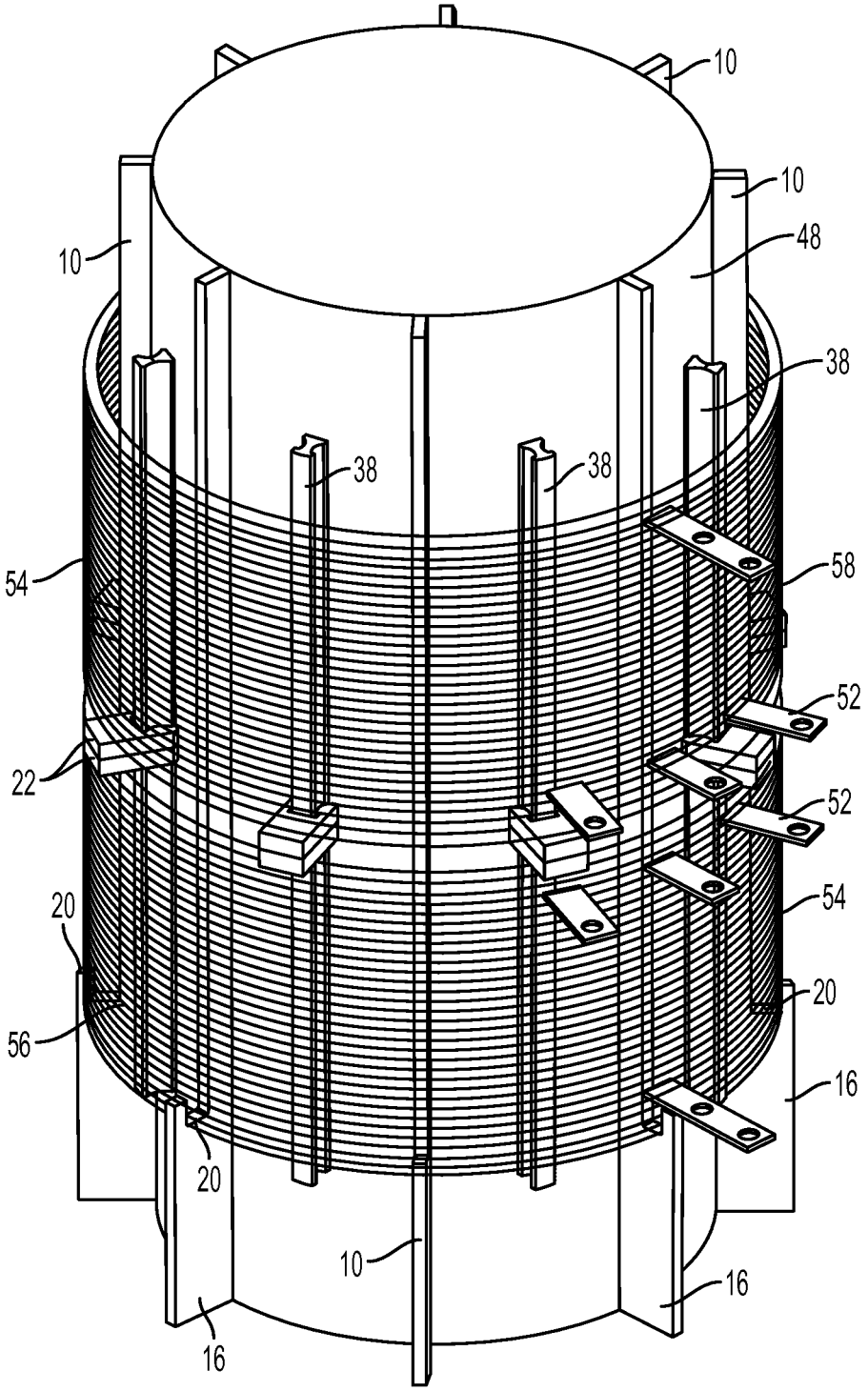
FIG. 5 is a view of the barrier of FIG. 4, shown with the conductor wound about the posts.

With reference to FIG. 5, with the spacers 22 removed or not yet installed on the guide 38, during an open winding process, a drop winding conductor or round wire 54 will fall and build up lengthwise along the posts 10 and guides 38 to control the radial and vertical build of the wire 54 while limiting the probability that a turn could drop down and cause a higher than designed dielectric stress from turn to turn. The turns of conductor 54 will fall from the top to the bottom in a partially random fashion to fill the dedicated conductor space. Thus, the wire 54 fills the slots 20 of the legs 16 and builds from the slots 20 upwardly to form a generally cylindrical winding supported by the legs 16.

Figure 6:
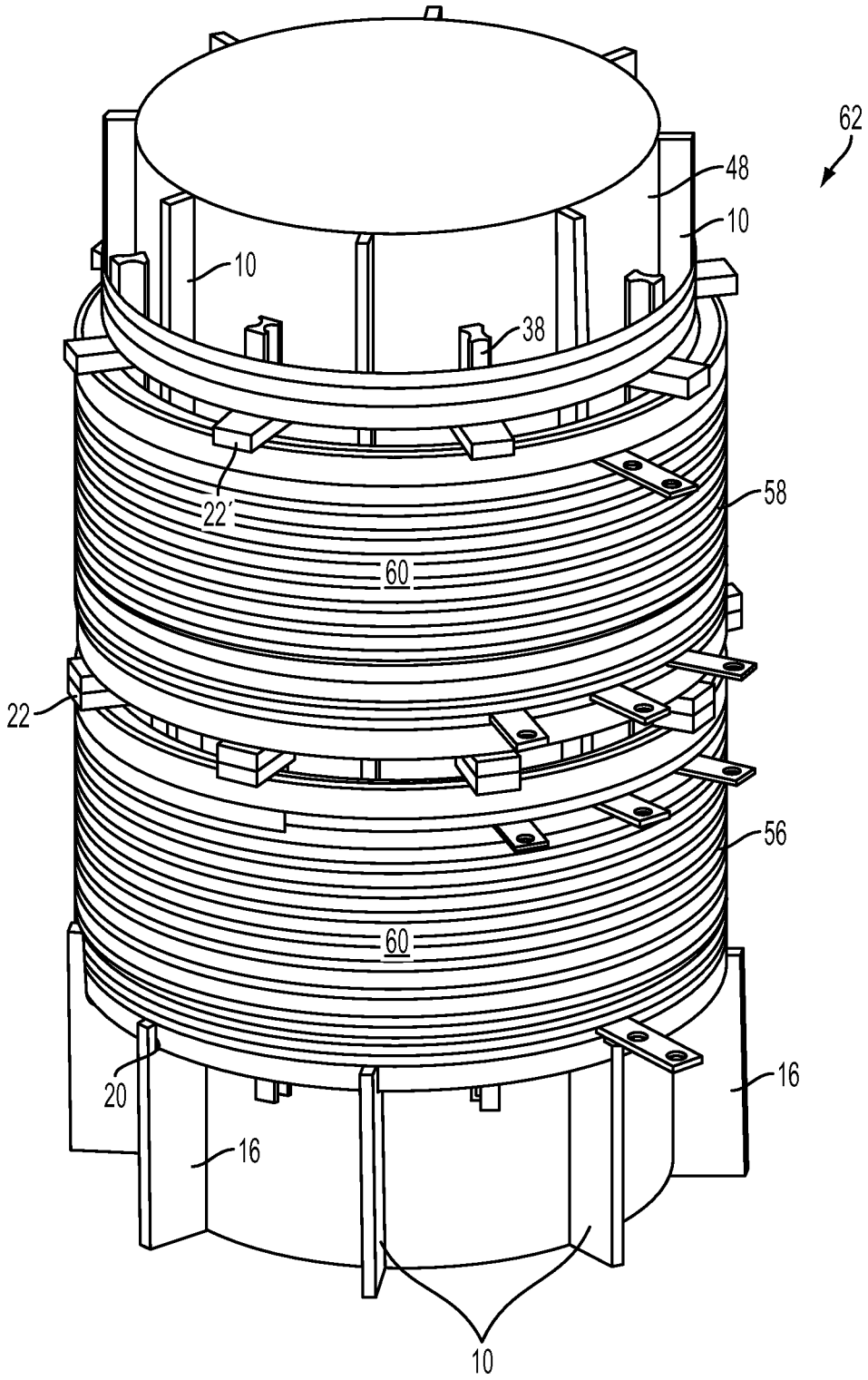
FIG. 6 is a view of the barrier with conductor of FIG. 5, shown with a glass tape overlap.

In the embodiment shown in FIG. 5, the winding is optionally divided at least two more generally cylindrical segments 56 and 58 to allow for the voltage adjustment taps 52 supported off of a mechanical tap box (not shown). Once the lower or first winding segment 54 is completed, the middle spacers 22 are slid onto the guides 38 into position at the desired location above the winding segment 56. Thus, each spacer 22 extends outwardly from the associated guide 38. Thereafter, the upper or second winding segment 58 is created by dropping more of the wire 54 along the posts 10 above the spacers 22. The spacers 22 are disposed between the segments 56 and 58 and prevent electrical contact between the segments 56 and 58. The middle spacers 22 are secured from vertical movement with respect to the guides 38 by the segments 56 and 58. In the embodiment, the middle spacers 22 can be in stacked, abutting relation to increase separation between the segments 56, 58. As shown in FIG. 6, top spacers 22' can be provided above segment 58 as well such that first winding segment 56 is disposed between the legs 16 of the post 10 and the middle spacers 22, and the second winding segment 58 is disposed between the middle spacers 22 and the top spacers 22' to prevent axial movement of the winding segments during manufacturing, shipping, installation, energization or fault conditions.

Figure 7:
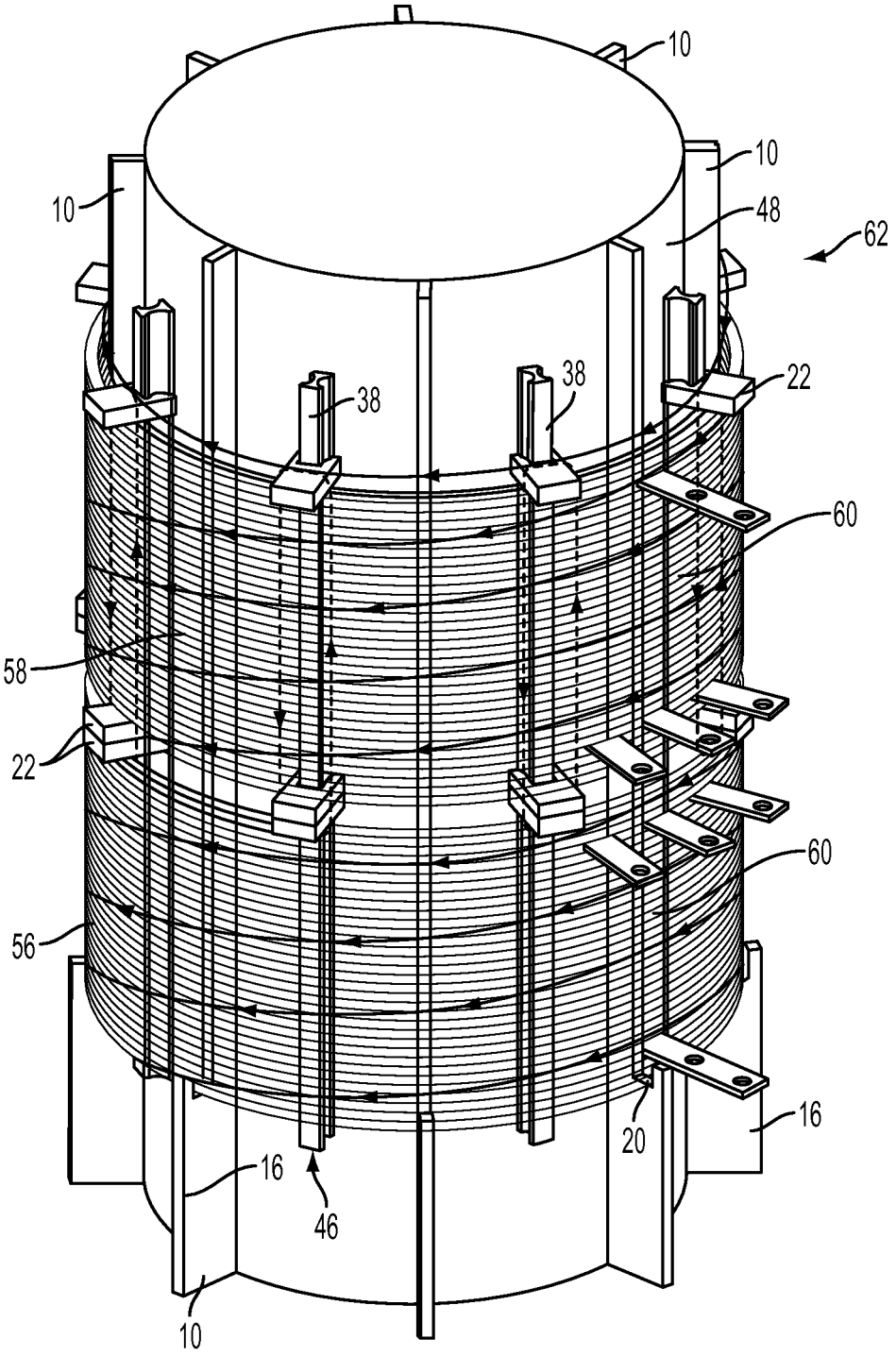
FIG. 7 is a view showing directions of winding of the tape overlap of FIG. 5, with the dashed lined arrows showing overlap being wound prior to the solid line arrows, in accordance with an embodiment.
Figure 8:
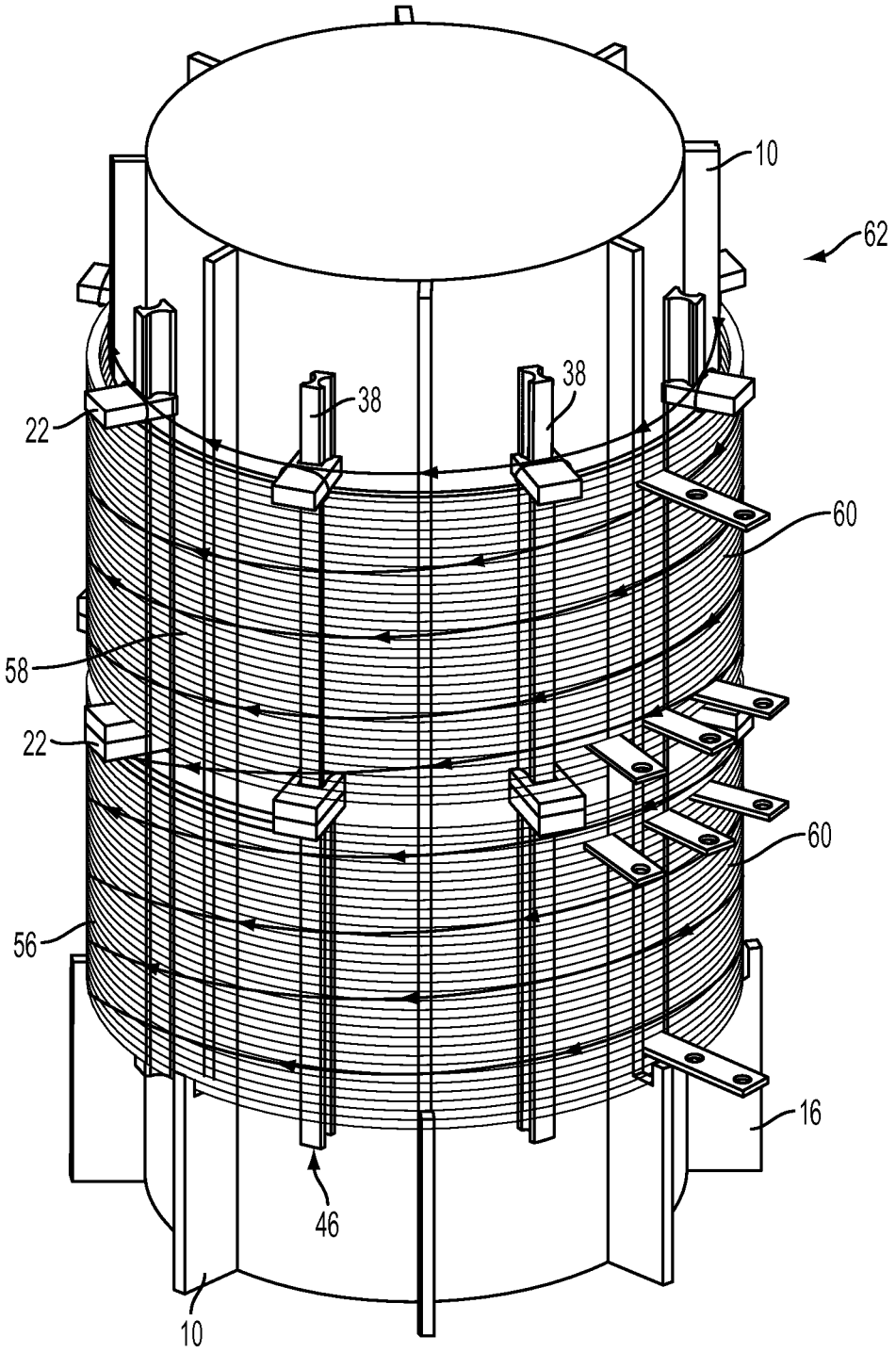
FIG. 8 is a view showing a direction of winding of the tape overlap of FIG. 5, in accordance with another embodiment.

FIG. 6 also shows glass tape or weave overlap 60 wrapped on segments 58 and 60, defining a medium voltage radial drop winding, 62, for open wound transformers in accordance with an embodiment. The overlap 60 stabilizes the winding segments 56, 58 and to protects them from environmental contaminants and mechanical damage. The tape overlap 60 is saturated with varnish or epoxy and is cured to hold its form. A first method of wrapping the segments 56, 58 is shown in FIG. 7, wherein the dashed lined arrows show overlap 60 being wound prior to the solid line arrows. The direction of wrap is shown by the arrows. FIG. 8 shows another way to wrap the overlap 60.

The posts 10 and spacer structure 20 ensure that the winding segment(s) hold a predictable shape and survive the manufacturing, shipping, installation, and energization processes.

This drop winding concept can be applied to medium voltage dry type transformers that use a dipped or sprayed varnish coating process for environmental protection and enhanced mechanical performance. It can be used with aluminum or copper windings, paper/film wrapped conductors or film coated conductors at voltages presently up to 36 kV and 2 MVA, although even higher distribution voltages and higher distribution MVAs are contemplated.

The medium voltage radial drop winding 62 for open wound/ventilated coils will reduce direct labor and increases the effective fill factor, while maintaining a nearly linear voltage distribution inside the winding. The open wound or open ventilated coils do not use solid epoxy to fill the space between the coils or turns in the same winding. The radial drop winding 62 solves the issue of how to apply radial drop windings on open wound transformers without relying the vacuum cast or resin encapsulated process.

Other advantages of the medium voltage radial drop winding 62 includes the reduction of material content, does not require vacuum cast or resin encapsulated processes, reduces manufacturing time, enhances mechanical performance versus a typical open wound disk configuration, and reduces overall footprint and weight.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A radial drop winding for an open wound transformer comprising:

support structure including a plurality of non-electrically conductive posts, each post being of generally L-shape having an elongated main body and a leg extending from a bottom end of the main body, the posts being arranged so as to define an interior space, the main body having a continuous planar outer surface extending to the leg and constructed and arranged to permit a plurality of turns of conductive wire to be dropped lengthwise along the outer surface, and at least one generally cylindrical winding segment comprising the plurality of turns of the conductive wire disposed about the posts and supported by the legs, wherein each leg includes a U-shaped slot therein extending lengthwise of the post and receiving a portion of the winding segment.

2. The winding of claim 1, wherein first and second winding segments are provided and wherein movable spacer structure separates the first and second winding segments so as to prevent electrical contact there-between.

3. The winding of claim 2, wherein the spacer structure comprises:

a plurality of guides, each guide being provided between two of the posts, and at least one middle spacer coupled to each guide so as to separate the first and second winding segments.

4. The winding of claim 3, wherein each guide has opposing sides and each side includes an elongated channel defined therein, wherein each spacer has a body with a first end and an opposing second end and a slot in the second end defining first and second opposing legs, each leg including a protrusion, wherein a portion of each guide is received in the slot of an associated spacer with the protrusions of the associated spacer engaging surfaces defining the channels of the guide.

5. The winding of claim 4, wherein each channel is defined as a generally arc-shaped trough and the protrusions are convex.

6. The winding of claim 4, wherein each spacer is slidable along the surfaces defining the channels of the associated guide.

7. The winding of claim 4, wherein each slot is of generally rectangular shape that receives the portion of the associated guide.

8. The winding of claim 3, further comprising at least one top spacer coupled to each guide, with the first winding segment being disposed between the legs of the post and the middle spacers, and the second winding segment being disposed between the middle spacers and the top spacers to prevent axial movement of the winding segments.

9. The winding of claim 2, wherein each post and each spacer structure is composed of polyester glass.

10. The winding of claim 1, further comprising glass weave or tape wrapped around the at least one winding segment.

11. A radial drop winding for an open wound transformer comprising:

support structure including a plurality of non-electrically conductive posts, each post being of generally L-shape having an elongated main body and a leg extending from a bottom end of the main body, the posts being arranged so as to define an interior space, the main body having a continuous planar outer surface extending to the leg and constructed and arranged to permit a plurality of turns of conductive wire to be dropped lengthwise along the outer surface, at least one generally cylindrical winding segment comprising the plurality of turns of the conductive wire disposed about the posts and supported by the legs, wherein each leg includes a U-shaped slot therein extending lengthwise of the post and receiving a portion of the winding segment; and a barrier having a cylindrical periphery and an interior space, the posts being coupled directly to the cylindrical periphery of the barrier so that the posts extend outwardly from the cylindrical periphery along a length of the barrier.

* * * * *